US009943941B1

(12) United States Patent
Grom

(10) Patent No.: US 9,943,941 B1
(45) Date of Patent: Apr. 17, 2018

(54) SANDING TOOL FOR MOLDING MACHINE

(71) Applicant: Bill Grom, Hotchkiss, CO (US)

(72) Inventor: Bill Grom, Hotchkiss, CO (US)

( * ) Notice: Subject to any disclaimer, the term of this patent is extended or adjusted under 35 U.S.C. 154(b) by 28 days.

(21) Appl. No.: 15/443,391

(22) Filed: Feb. 27, 2017

Related U.S. Application Data

(60) Provisional application No. 62/300,321, filed on Feb. 26, 2016.

(51) Int. Cl.

| | |
|---|---|
| ***B24B 7/12*** | (2006.01) |
| ***B24B 41/02*** | (2006.01) |
| ***B24B 41/00*** | (2006.01) |
| ***B24B 27/00*** | (2006.01) |
| *B24D 13/06* | (2006.01) |
| *B24D 13/04* | (2006.01) |

(52) U.S. Cl.
CPC ..... *B24B 7/12* (2013.01); *B24B 27/0092* (2013.01); *B24B 41/005* (2013.01); *B24B 41/02* (2013.01); *B24D 13/04* (2013.01); *B24D 13/06* (2013.01)

(58) Field of Classification Search
CPC ..... B24B 7/12; B24B 23/02; B24B 23/022; B24B 23/005; B24B 25/00; B24B 27/092; B24B 41/005; B24B 41/068; B24B 41/02; B24D 13/04; B24D 13/06; B24D 13/10
See application file for complete search history.

(56) References Cited

U.S. PATENT DOCUMENTS

| | | | | |
|---|---|---|---|---|
| 3,032,931 | A * | 5/1962 | Eversole | B24B 7/02 451/121 |
| 3,132,452 | A | 5/1964 | Block | |
| 3,540,169 | A | 11/1970 | Mahomey | |
| 3,857,750 | A * | 12/1974 | Winter | B24B 39/006 428/323 |
| 4,277,917 | A | 7/1981 | Ali et al. | |
| 4,612,738 | A | 9/1986 | Pittinger, Sr. et al. | |
| 4,660,609 | A * | 4/1987 | Miller, Jr. | B23Q 1/70 144/114.1 |
| 4,720,940 | A | 1/1988 | Green | |
| 5,531,636 | A * | 7/1996 | Bissen | B24B 7/12 451/130 |
| 6,752,706 | B1 | 6/2004 | Chuang | |
| 7,004,828 | B1 * | 2/2006 | Picou | B24B 41/005 451/358 |
| 7,503,832 | B1 * | 3/2009 | Chang | B24B 7/005 451/11 |
| 2007/0010183 | A1 * | 1/2007 | Himmer | B24D 13/10 451/466 |

* cited by examiner

*Primary Examiner* — Timothy V Eley
(74) *Attorney, Agent, or Firm* — Aaron R. Cramer; Cramer Patent & Design, PLLC

(57) ABSTRACT

A sanding tool is adapted to be attached to an existing wood board molding machine. The sanding tool provides a rotating sanding drum which removes imperfections from the profile of the molding as it exits the molding machine. The sanding drum is height adjustable and is powered by an electric motor.

14 Claims, 4 Drawing Sheets

SANDING TOOL FOR MOLDING MACHINE

RELATED APPLICATIONS

This application is a Continuation-in-part and claims the benefit of U.S. Provisional Application No. 62/300,321 which was filed Feb. 26, 2016, the entire disclosures of which are incorporated herein by reference.

FIELD OF THE INVENTION

The present invention relates generally to a sanding tool capable of being attached an operable with a molding machine.

BACKGROUND OF THE INVENTION

When operating machines, especially in woodworking or other disciplines where constant manipulation of the work product must be done in order to properly and aesthetically complete the work, it is particularly useful to have adjustments or attachments made that are easy and ergonomic to utilize. After repeated work over the space of even a few hours, temporary or permanent damage to the hands or muscles of the user can occur. In order to continue work and produce a high quality product, a solution must be provided in order to allow the craftsman to safely and repeatedly operate such machines. Such an attachment that enables a user to have a system where one can combine molding operations and sanding operations, common tasks done subsequently in the woodworking industry, would be beneficial.

Various attempts have been made to solve problems found in attachments for sanding tools. Among these are found in: U.S. Pat. and U.S. Pat. No. 7,004,828 to Picou, U.S. Pat. No. 6,752,706 to Chuang, and U.S. Pat. No. 4,660,609 to Miller, Jr. These prior art references are representative of sanding tool attachments.

None of the above inventions and patents, taken either singly or in combination, is seen to describe the invention as claimed. Thus, a need exists for a such a system in which molding and sanding operations can be combined into a single system, and to avoid the above-mentioned problems.

SUMMARY OF THE INVENTION

The principles of the present invention provide for a sanding tool, comprising a first side frame having a first, second, third, fourth, fifth, sixth, seventh and eighth side frame edge, a first side frame keyhole aperture which is subjacent the first side frame seventh edge and between the first side frame sixth edge and the first side frame eighth edge, a first side frame first height adjusting aperture which is subjacent the first side frame first edge and adjacent the first side frame keyhole aperture and a first side frame first pivot aperture which is subjacent the first side frame first edge and adjacent the first side frame first height adjusting aperture.

The sanding tool also comprises a second side frame having a first, second, third, fourth, fifth, sixth, seventh and eighth side frame edge, a second side frame keyhole aperture which is subjacent the second side frame seventh edge and between the second side frame sixth edge and the second side frame eighth edge, a second side frame first height adjusting aperture which is subjacent the second side frame first edge and adjacent the second side frame keyhole aperture and a second side frame first pivot aperture which is subjacent the second side frame first edge and adjacent the second side frame first height adjusting aperture.

The sanding tool additionally comprises a sander drum frame assembly. The sander drum frame assembly comprises a sander drum carriage outer frame first side, a sander drum carriage outer frame second side which is positioned opposite the sander drum carriage outer frame first side, a sander drum carriage outer frame third side which is secured between a first edge of the sander drum carriage outer frame first side and the sander drum carriage outer frame second side, a sander drum carriage outer frame fourth side which is positioned opposite the sander drum carriage outer frame third side and secured between a second edge of the sander drum carriage outer frame first side and the sander drum carriage outer frame second side, a sander drum carriage inner frame member which is secured across a topside edge of the sander drum carriage outer frame third side and a topside edge of the sander drum carriage outer frame fourth side, a sander drum carriage outer frame first side height adjusting aperture which has an arcuate shape which is located adjacent a first edge of the sander drum carriage outer frame first side, a sander drum carriage outer frame first side pivot aperture which is located adjacent a second edge of the sander drum carriage outer frame first side which is opposite the sander drum carriage outer frame first side height adjusting aperture, a sander drum carriage outer frame second side height adjusting aperture which has an arcuate shape that is located adjacent a first edge of the sander drum carriage outer frame second side and a sander drum carriage outer frame second side pivot aperture which is located adjacent a second edge of the sander drum carriage outer frame second side opposite the sander drum carriage outer frame second side height adjusting aperture.

The sander drum frame assembly is capable of being pivotally secured between the first side frame and the second side frame when the first side frame first height adjusting aperture is aligned with the sander drum carriage outer frame first side height adjusting aperture and conjoined with a first fastener, when the first side frame first pivot aperture is aligned with the sander drum carriage outer frame first side pivot aperture and conjoined with a second fastener, when the second side frame first height adjusting aperture is aligned with the sander drum carriage outer frame second side height adjusting aperture and conjoined with a third fastener and when the second side frame first pivot aperture is aligned with the sander drum carriage outer frame second side pivot aperture and conjoined with a fourth fastener. The sander drum frame assembly also has a sander drum frame open top and a sander drum frame open bottom.

The sanding tool also comprises a sander drum assembly which is secured within the sander drum frame assembly and protrudes through the sander drum frame open top and the sander drum frame open bottom, a tension assembly secured within and between the first side frame keyhole aperture and the second side frame keyhole aperture and a motor capable of being in electrical communication with a power source and in mechanical communication with the sander drum assembly. The tool is securable over an output table of a molding machine comprising a cutter assembly. When the tool is actuated, a top face of a piece of molding existing within the molding machine and simultaneously supported upon the output table is brought into physical contact with the sander drum assembly. The sander drum assembly is also capable of contacting the top face of the piece of molding. In a separate embodiment, the molding machine is provided as part of the sanding tool.

The sander drum assembly may also comprise of a first pillow block assembly which is secured to a top side edge of the sander drum carriage outer frame first side, a second pillow block assembly which is secured to a top side edge of the sander drum carriage outer frame second side, a sander shaft having a first plurality of journal bearings disposed adjacent a sander shaft first end and a second plurality of journal bearings disposed adjacent a sander shaft second end, a core secured about the sander shaft between the first pillow block assembly and the second pillow block assembly, a plurality of sanding strips which are radially disposed and project outward from an outer surface of the core, a first lock collar which is secured between the first pillow block and a core first side by a first jam nut, a second lock collar which is secured between the second pillow block and a core second side by a second jam nut, a sander pulley which is secured about the sander shaft first end and a sander drive belt which is secured about the sander pulley. The first plurality of journal bearings is secured within an inner race of the first pillow block assembly while the second plurality of journal bearings are secured within an inner race of the second pillow block assembly. The sander shaft first end projects through and away from the first pillow block assembly outer face while the sander shaft second end projects through and away from the second pillow block assembly outer face. The sander drive belt is in mechanical communication with the motor.

The tension assembly may further comprise a sander out-feed roll which itself comprises a roll cover and a roll shaft resting within an interior space of the roll cover. A first end of the out-feed roll rests within the first side frame keyhole aperture while a second end of the out-feed roll rests within the second side frame keyhole aperture. The tension assembly also may comprises a first tension stud which is perpendicularly secured through the first side frame seventh edge, the first side frame keyhole aperture and into the sander out-feed roll first end, a second tension stud perpendicularly secured through the second side frame seventh edge, the second side frame keyhole aperture and into the sander out-feed roll second end, a first tension spring which is secured around a portion of the first tension stud which resides within the first side frame keyhole aperture, a second tension spring which is secured around a portion of the second tension stud which resides with the second side frame keyhole aperture, a first tension nut which is secured about a protruding portion of the first tension stud above the first side frame seventh edge, a second tension nut which is secured about a protruding portion of the second tension stud above the second side frame seventh edge, an out-feed rod pulley which is secured about a protruding portion of the out-feed roll second end on an exterior side of the second side frame keyhole aperture and an out-feed roll drive belt capable of transferring rotational motion from the molding machine to the out-feed rod pulley.

A first rotation of the first tension nut and a first rotation of the second tension nut exerts a downward force upon the sander out-feed roll capable of providing continuous contact with the top face of the piece of molding. The rotation of the molding machine is capable of facilitating a rotation of the sander out-feed roll which in turn is capable of facilitating an ejection from the molding machine of the molding beneath the plurality of sanding strips when in contact with the top face of the piece of molding.

The electrical motor may further comprise a motor mounting plate which is configured to secure the motor to the molding machine subjacent the output table, a motor shaft projecting from the motor subjacent the first side frame, a motor pulley secured about the motor shaft and a power cord capable of providing electrical communication between the motor and the power source. The sander drive belt is in operable communication with the motor pulley. The motor mounting plate may be hingedly secured to the molding machine.

The sanding tool may further comprise a first mounting bracket which is secured to the first side frame second edge and a second mounting bracket which is secured to the second side frame second edge. The plurality of sanding strips may also comprise a first sanding row, a second sanding row and a third sanding row. The first sanding row has a width less than the second sanding row and the second sanding row has a width less than the third sanding row. The first sanding row, the second sanding row and the third sanding row are arranged in a uniform and sequential pattern about the core. The plurality of sanding strips may further comprise a fourth row having back-up bristles between the third sanding row and the first sanding row. The first sanding row may have a width of one-sixteenth of an inch (1/16 in.) the second sanding row may have a width of one-eighth of an inch (1/8 in.) and the third sanding row may have a width of three-sixteenths of an inch (3/16 in.)

The sanding tool may further comprise a first side frame flange disposed upon an exterior edge of the first side frame third edge, the first side frame fourth edge, the first side frame fifth edge, the first side frame sixth edge, the first side frame seventh edge and the first side frame eighth edge while a second side frame flange is disposed upon an exterior edge of the second side frame third edge, the second side frame fourth edge, the second side frame fifth edge, the second side frame sixth edge, the second side frame seventh edge and the second side frame eighth edge.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
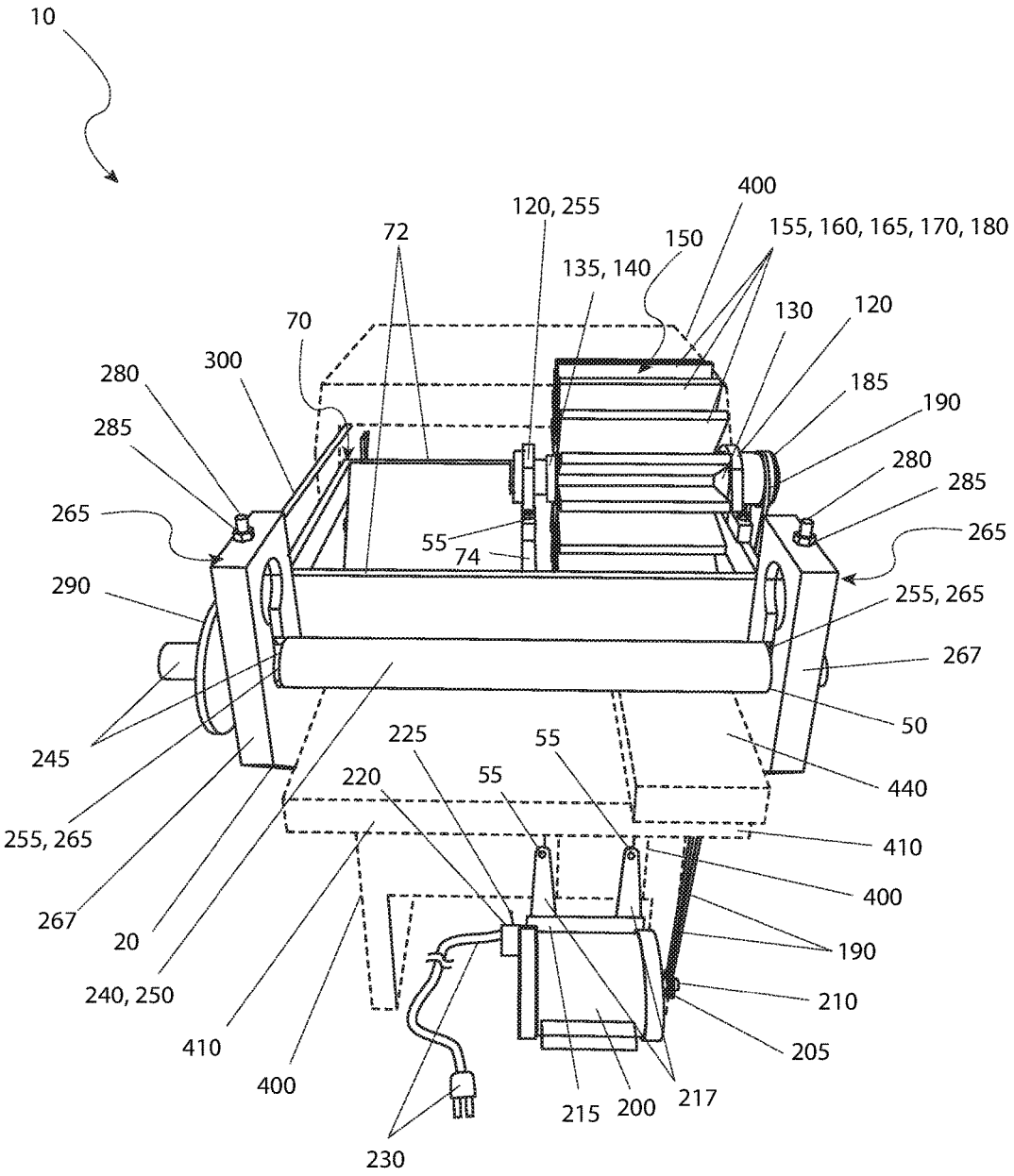
FIG. 1 is a rear perspective view of a sanding tool 10 in accordance with the preferred embodiment of the present invention.

10 sanding tool
20 first side frame
30 second side frame
35 peripheral flange
45*a* first height adjusting aperture
45*b* second height adjusting aperture
47*a* first pivot aperture
47*b* second pivot aperture
50 keyhole frame aperture
55 threaded fastener

60 mounting bracket
65 slot
70 sander drum frame assembly
72 sander carriage outer frame
74 sander carriage inner frame member
76 first sander carriage side panel
78 second sander carriage side panel
120 pillow block bearing
130 sander shaft
135 jam nut
140 lock collar
150 sander drum assembly
155 core
160 first sanding row
165 second sanding row
170 third sanding row
175 sanding strip
180 back-up bristle
185 sander shaft pulley
190 sander drive belt
200 motor
205 motor shaft
210 motor pulley
215 motor mounting plate
217 hinge
220 junction box
225 power switch
230 power cord
240 sander out-feed roll
245 roll shaft
250 roll cover
255 journal bearing
265 tension assembly
267 tension structure
270 roll tension spring
280 tension stud
285 tension nut
290 out-feed roll pulley
300 out-feed roll drive belt
400 existing molding machine
410 molding table
420 machine frame portion
440 molding

DETAILED DESCRIPTION OF THE PREFERRED EMBODIMENT

The best mode for carrying out the invention is presented in terms of its preferred embodiment, herein depicted within FIG. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a sanding tool (herein referred to as the "device") 10, which is adapted to be attached to an existing wood board molding machine 400 having an internal cutter assembly (not shown) over a molding table 410. The device 10 provides a means to remove imperfections, such as, but not limited to, cutting tool chatter marks, from the profile of a piece of molding 440 remaining therein after being formed in the existing molding machine 400.

Figure 2:
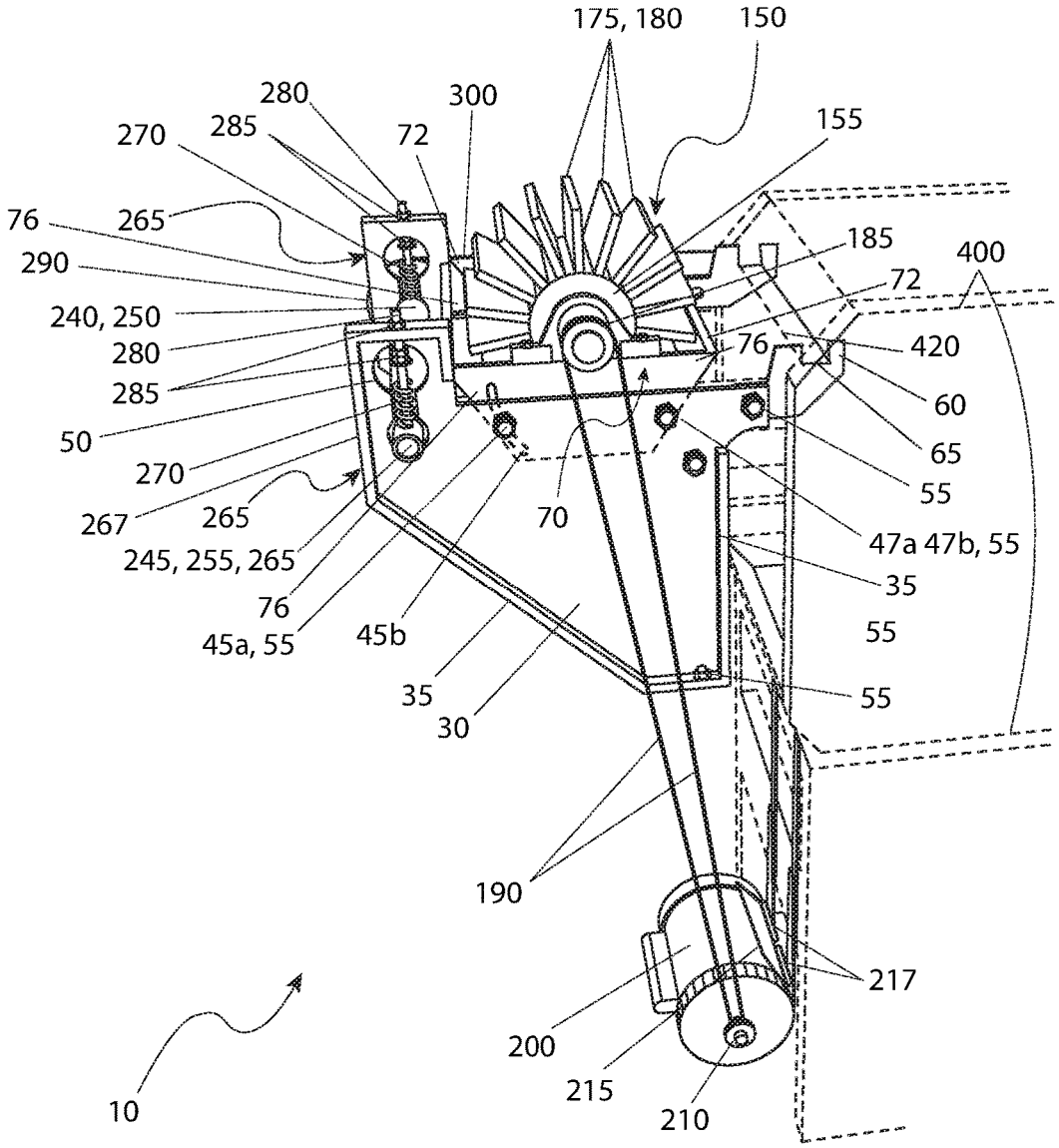
FIG. 2 is a left side perspective view of the sanding tool 10, in accordance with the preferred embodiment of the present invention.
Figure 3:
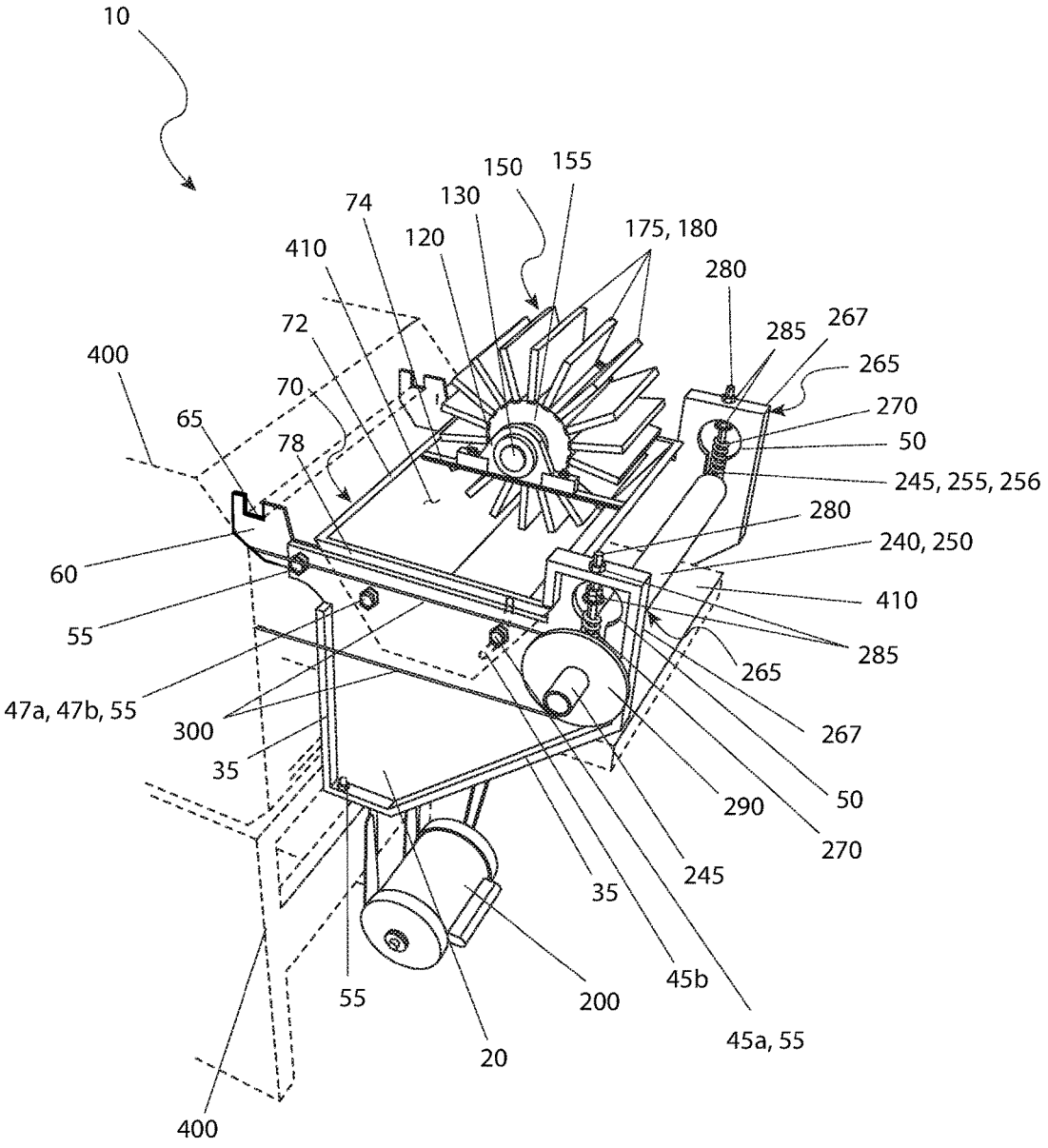
FIG. 3 is a right side perspective view of the sanding tool 10, in accordance with the preferred embodiment of the present invention; and, FIG. 4 is an isolated view of second side frame 30, sander drum frame assembly 70, and sander drum assembly 150 portions of the sanding tool 10 in accordance with the preferred embodiment of the present invention.

Referring now to FIGS. 1, 2 and 3, rear, left, and right perspective views of the device 10, according to the preferred embodiment of the present invention, are disclosed. The device 10 includes a sander drum assembly 150 driven by an electric motor 200 which is pivotingly mounted to machine frame portions 420 of the existing molding machine 400 by a pair of mounting brackets 60. The sander drum assembly 150 is supported by a sander drum frame assembly 70, which is in turn supported by a first side frame 20 and a second side frame 30. The first side frame 20 and the second side frame 30 are vertical plates which provide a mounting means of the device 10 to machine frame portions 420 of the existing molding machine 400. Each side frame 20, 30 is provided with a plurality of strengthening peripheral flanges 35 positioned along peripheral edge portions of the side frames 20, 30. The side frames 20, 30 are composed of metal having sufficient structural integrity to accomplish the intended task. Other materials, such as wood, or a laminated composite, may be utilized without limiting the scope of the device 10. The peripheral flanges 35 are configured being formed perpendicularly to the principle plane thereof. The peripheral flanges 35 increase the structural rigidity of the side frames 20, 30 as well as providing a convenient location for fastening the side frames 20, 30 to the molding machine 400 using a plurality of threaded fasteners 55. Disposed along a forward edge of each side frame 20, 30 toward the molding machine 400, is a mounting bracket 60. Each mounting bracket 60 is affixed to the corresponding side frame 20, 30 using a threaded fastener 55, and acts as a planar extension of each side frame 20, 30. The mounting brackets 60 are utilized for the purpose of providing an attachment point for the device 10 to various makes and models of existing molding machines 400. It is envisioned that variously designed mounting brackets 60 which correspond to various popular molding machines 400, would be made available, thereby enabling attachment of the device 10 to a wide variety of existing molding machines 400. Each mounting bracket 60 is provided with a slot 65 or similar feature, being shaped so as to capture or interlock with a machine frame portion 420 of the existing molding machine 400. The mounting brackets 60 are composed of metal and are generally configured to conform to the intended purpose. It is understood that other materials, such as wood, or carbon nanotubes, may be utilized without limiting the scope of the device 10.

The second side frame 30 is configured to be opposite hand from the first side frame 20. The side frames 20, 30 are to be positioned vertically along opposing side portions of the device 10 in a parallel manner. Disposed in each side frame 20, 30, in a horizontally aligned manner, is a circular first height adjusting aperture 45*a* and a circular first pivot aperture 47*a* which provide pivoting attachment of the aforementioned sander drum frame assembly 70 (also see FIG. 4). Furthermore, the side frames 20, 30 would include additional fastener apertures along peripheral flange portions 35 for the attachment of the device 10 to the molding machine 400.

The sander drum frame assembly 70 provides a unitary weldment providing support and attachment of the sander drum assembly 150. The sander drum frame assembly 70 includes a planar weldment including a sander carriage outer frame 72 and a sander carriage inner frame member 74, preferably made using metal rectangular structural tubing. The sander carriage inner frame member 74 acts to bisect the rectangular sander carriage outer frame 72, resulting in a rectangular planar structure having two (2) rectangular openings through which the sander drum assembly 150 protrudes. The two (2) rectangular openings formed by the sander carriage outer frame 72 and the intermediately bisecting sander carriage inner frame member 74 are envisioned to facilitate other embodiments of the device 10 which may utilize one (1) or two (2) sander drum assemblies 150, if desired. The sander drum frame assembly 70 further includes a first sander carriage side panel 76, and a second sander carriage side panel 78 which are welded to respective opposing end portions of the sander carriage outer frame 72. The side panels 76, 78 protrude perpendicularly downward therefrom the sander carriage outer frame 72 in a parallel manner. The first sander carriage side panel 76 and second sander carriage side panel 78 are in turn pivotingly attached to the previously described first 20 and second 30 side frame portions (see FIG. 4). It is envisioned that alternate configurations of the sander drum frame assembly 70, utilizing other materials, or additional components, may exist in other embodiments of the present device 10 without limiting the scope or the teachings of this disclosure.

The planar configuration of the sander drum frame assembly 70 provides for the attachment of the sander drum assembly 150 along an upper surface via a pair of pillow block bearings 120 mounted to the sander drum frame assembly 70 using threaded fasteners 55. The pillow block bearings 120 are inserted upon opposing ends of a sander shaft portion 130 of the sander drum assembly 150. The pillow block bearings 120 may be any commercially available component, as supplied by several manufacturers, to adequately support the sander shaft 130 and permit the desired rotation thereof and should not be perceived as limiting the scope of the device 10.

The generally cylindrical sander shaft 130 is envisioned to include journal bearing portions 255 sized to be inserted into the inner races of the pillow block bearings 120 in a customary fashion. A proximal end of the sander shaft 130 is positioned closest to sander shaft pulley 185 and drive motor 200 portions, while a distal end of the sander shaft 130 is at an opposing end position. Disposed along a central portion of the sander shaft 130 is a turned surface intended to be inserted into a cylindrical core portion 155 of the sander drum assembly 150. A lock collar utilizing a set screw 140 is secured about the sander shaft 130 to facilitate installation of jam nuts 135 which are intended to secure the sander drum assembly 150 at a fixed lateral location upon the sander shaft 130. Attached at the proximal end of the sander shaft 130 is a sander shaft pulley 185. The sander shaft pulley 185 is a commercially available component being sized so as to provide a selected rotational velocity to the sander shaft 130 and hence the attached sander drum assembly 150. It is envisioned that any necessary shoulder, keyway, chamfer, or fillet may be formed into the sander shaft 130 to accomplish the function and service thereof without limiting the scope or the intent of the device 10.

The motor 200 includes an integral planar motor mounting plate 215 along an external surface which enables attachment of a pair of hinges 217 to the motor 200 using threaded fasteners 55. The hinges 217 are arranged along a common axis and are also attached to machine frame portions 420 of the existing molding machine 400, thereby allowing the motor 200 to pivot with respect to the existing molding machine 400. The motor 200 includes motor shaft 205 and motor pulley 210 portions in a conventional manner. The motor pulley 210 provides a rotational torsion to the aforementioned sander shaft pulley 185 via an interconnecting sander drive belt 190. The configuration of the motor 200 and hinges 217 allow the gravity of the motor 200 to act upon and retain a tightness of the sander drive belt 190.

The motor 200 is comprised of any of a variety of commercially available, copper wound 110-VAC, small frame devices, with a cylindrical motor shaft 205 capable of generating sufficient torque to induce the desired rotation of the sander drum assembly 150. The motor 200 is electrically powered through a two (2) position power switch 225, preferably located upon an easily accessible junction box 220. The power switch 225 is in electrical communication with a standard electrical supply source via a power cord 230. The power cord 230 depicted in the accompanying illustrations is provided with a standard, grounded plug for insertion into a conventional electrical receptacle. It is understood that in other embodiments, other provisions, such as direct wiring through an appropriately fused electrical disconnect switch, may be utilized without limiting the scope of the device 10. The motor pulley 210, as well as the sander shaft pulley 185, may be any commercially adaptable set of V-belt components selected to produce a desirable rotation speed of the sander drum assembly 150. The sander drive belt 190 is a commercially available V-belt having an appropriate length to maintain sufficient tension to transmit the required torque. It is envisioned that in other embodiments, variable drive pulleys, or alternate drive methods such as variable speed motors may be utilized without limiting the scope of the device 10.

The sander drum assembly 150 is composed of a plurality of sanding strips 175 uniformly attached to the peripheral surface of the cylindrical core 155. The sanding strips 175 are preferably composed of a fiber substrate, such as woven textile, with an abrasive material, such as a granulated mineral, attached thereto by any appropriate means, such as adhesive bonding. The abrasive material may vary in granule size in alternate embodiments to yield sanding strips 175 of different coarseness for abrading the molding 440 in a more, or less, aggressive manner. The fiber substrate of the sanding strips 175 may be impregnated with other natural, or synthetic, materials, such as polymers, or lacquers, to improve the service life thereof. The sanding strips 175 are arranged side-by-each across the width of the sander drum assembly 150 including a first sanding row 160, a second sanding row 165, and a third sanding row 170. The sanding strips 175 are arranged in an equally-spaced manner around the periphery of the core 155. The width of the sanding strips 175 in any one (1) row 160, 165, 170 will be uniform across that row 160, 165, 170 but will be variable in successive rows 160, 165, 170. A first sanding row 160 will include sanding strips 175 of a selected first width, preferably approximately one-sixteenth of an inch (1/16 in.). A second sanding row 165, in immediate peripheral succession in a preferred direction of rotation after the first sanding row 160, will include sanding strips 175 of a slightly greater width, preferably approximately one eighth of an inch (1/8 in.). A third sanding row 170 will be composed of laterally spaced sanding strips 175 of a third, and even greater width, preferably approximately three-sixteenths of an inch (3/16 in.). The rows 160, 165, and 170 will then be repeated in a uniform manner around the circumference of the core 155 so that the number of each will be identical. In this manner, the sanding strips 175 will enhance the profile details of the molding 440 while conforming to the general shape thereof. The sanding strips 175 of each sanding row 160, 165, 170 will be fortified in a tangential direction by the inclusion of a plurality of back-up bristles 180 placed in immediate peripheral succession in a preferred direction of rotation to the sanding strips 175. The back-up bristles 180 are configured to be approximately the same radial length as the sanding strips 175 and preferably composed of istle (a tampico fiber). The sanding strips 175, back-up bristles 180, and/or the entire sanding drum 150 may be replaced in a usual manner after having reached the extent of service life.

The preferred outcome of the sanding procedure will also be influenced by the tangential velocity of the sanding strips 175 relative to the molding 440. This relative velocity may be referred to as the sanding speed. The sanding speed can be modified by altering the speed ratio of the motor pulley 210 and the sander shaft pulley 185 in those embodiments in which those components exist. A skilled user may successfully accomplish this modification by replacing the motor pulley 210 and the sander shaft pulley 185 with alternate components having a more desirable ratio. In those embodiments that utilize variable pitch pulleys 185, 210, a modification in the pitch of one (1), or both, of those components, combined with any precipitated alteration in the tension of the sander drive belt 190, can be made. For those embodiments which utilize a variable speed motor 200, a modification can be made by adjusting the electrical signal to the motor 200 by an included method.

It is envisioned that, in some embodiments, additional guarding of moving components, and/or evacuation of sanding debris from the device 10 may be included without limiting the scope or the teachings of this enablement.

Each side frame 20, 30 includes an integrally welded tension assembly 265 which together, act to apply a downward force upon end portions of a sander out-feed roll 240. The sander out-feed roll 240 is provided to eject the molding 440 from the device 10 upon completion of the forming and sanding processes. The tension assemblies 265 are integral to upper rear edge portions of their respective side frames 20, 30. Each tension assembly 265 includes a tension structure 267, a roll tension spring 270, a tension stud 280, and a tension nut 285. The tension structures 267 form a rectangular upward protrusion having peripheral flanges 35 along three (3) sides, and act to support and mount the roll tension spring 270 and its included tension stud 280. The tension stud 280 protrudes from a top surface of the tension structure 267. A tension nut 285 is threadingly engaged upon a top end portion of the tension stud 280. As a position of the tension nut 285 is adjusted, the tension spring 270 acts upon a respective journal bearing 255 portion of the sander out-feed roll 240. The tension springs 270 are commercially available compression springs intended to exert a selective variable downward force on the journal bearings 255 and hence the sander out-feed roll 240.

The tension stud 280 is partially engaged in the center of the roll tension spring 270 and is further permitted to project upwardly through a circular aperture in a peripheral flange portion 35 of the tension structure 267. The tension stud 280 is configured to be a commercially available piece of threaded rod. The tension nut 285 is threaded onto the tension studs 280. It is envisioned that a second tension nut 285 would be utilized in a locking combination upon the tension stud 280 to disallow the tension stud 280 from bottoming out in the roll tension spring 270. At least one (1) tension nut 285 is then threaded into a position subjacent to the top-most peripheral flange 35 of the tension structure 267. At least one (1) other tension nut 285 is threaded onto the tension stud 280 superjacent to that peripheral flange 35. In this configuration, the tension stud 280 may be vertically adjusted to affect the downward force on the journal bearing 255, and hence the sander out-feed roll 240, by selectively positioning the tension nuts 285 and then being locked in that arrangement. The adjustment of the downward force on the sander out-feed roll 240 may be necessary to affect the movement of the molding 440 through the device 10.

The sander out-feed roll 240 is provided with a polymeric roll cover 250 adhesively attached to a preferably metallic roll shaft 245. The ends of the cylindrical roll shaft 245 are suspended in cylindrical journal bearings 255, which are in turn suspended in keyhole apertures 50 formed into each of the tension assemblies 265. The keyhole apertures 50 derive the name from the general shape thereof, namely a circular form, approximately conforming to the outside diameter of the journal bearings 255, with a subjacent, contiguous, elongated slot having an arcuate termination. The width of the slot is less than the diameter of the circular portion of the keyhole aperture 50. The journal bearings 255 are envisioned to be provided with oppositely configured bearing keyways into radially opposite sides of the journal bearings 255. The depth of the keyways would correspond generally to the width of the lower portion of the keyhole aperture 50. This particular configuration results in a spatial relationship in which the material of the side frame 20, 30 acts as a key in laterally retaining the journal bearings 255 as well as obviating any rotational movement thereof. The journal bearings 255 are composed of brass, or bronze, and may be further impregnated with a hydrocarbon solution to improve lubricity.

An out-feed roll pulley 290 is installed onto the roll shaft portion 245 of the sander out-feed roll 240. The sander out-feed roll 240 is preferably driven by connection of the out-feed roll pulley 290 to an existing out-feed roll pulley portion of the existing molding machine 400 using an out-feed roll drive belt 300. If such an arrangement of the out-feed roll pulley 290 and an existing out-feed roll pulley of the existing molding machine 400 is not possible, an installation kit or modifications to the existing molding machine 400 may be necessary to obtain this feature of the installation. The out-feed roll pulley 290 may be any commercially adaptable V-belt component selected to produce a desirable rotation speed of the sander out-feed roll 240. An out-feed roll drive belt 300 is to provide a drive impetus to the sander out-feed roll 240. The out-feed roll drive belt 300 is a commercially available V-belt having an appropriate length.

Figure 4:
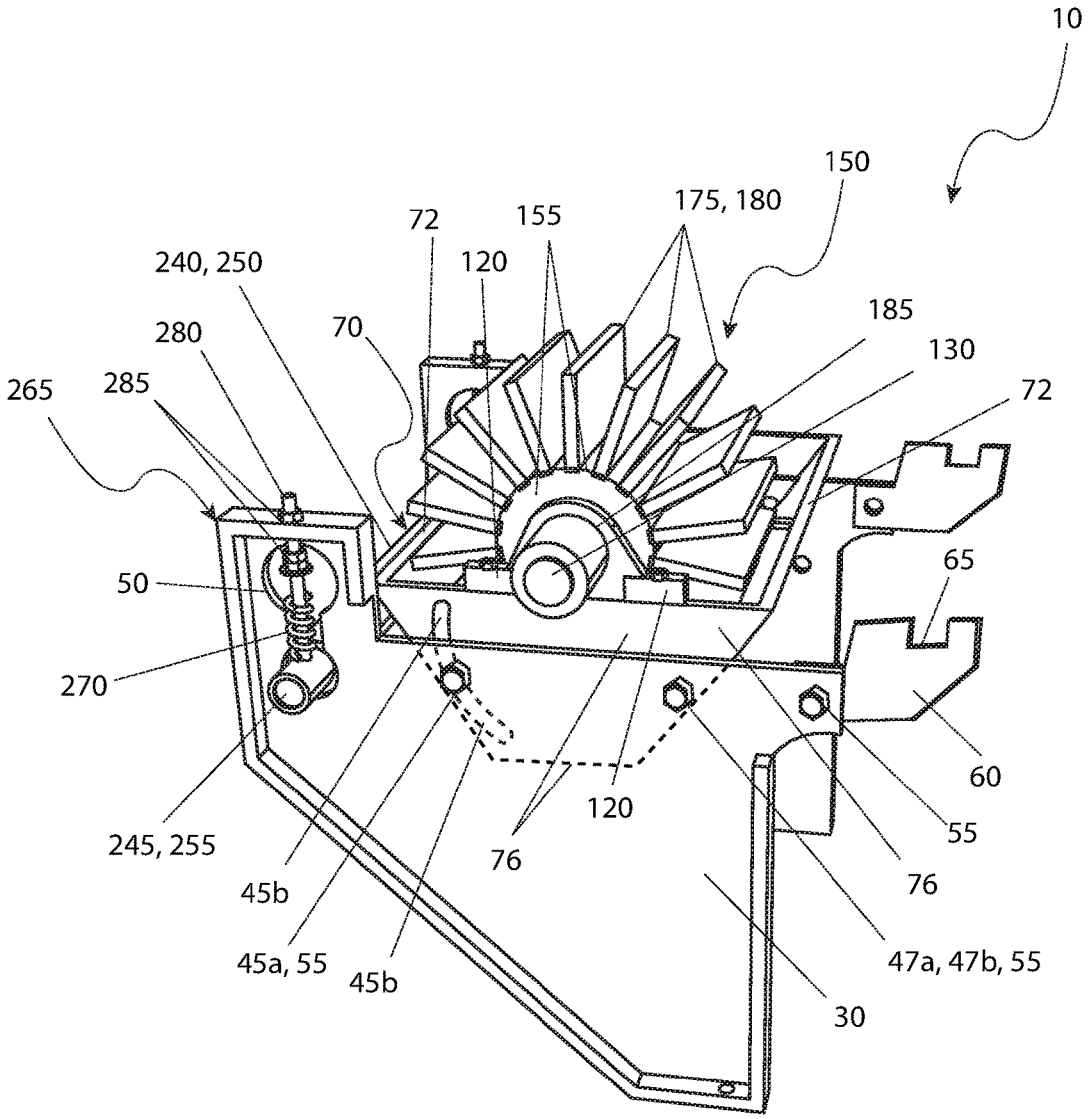

Referring now to FIG. 4, an isolated view of second side frame 30, sander drum frame assembly 70, and sander drum assembly 150 portions of the device 10 in accordance with the preferred embodiment of the present invention, is disclosed. In use, it may be necessary to alter the proximity of the sanding strip portions 175 of the sander drum assembly 150 to the molding 440 in order to affect a more desirable modification in the resultant profile of the molding 440. The device 10 provides a means to pivotingly adjust and secure the sander drum frame assembly 70 with respect to the side frames 20, 30. Each of the parallel sander carriage side panel portions 76, 78 of the sander drum frame assembly 70 include an arcuate second height adjusting aperture **45*b* and a circular second pivot aperture 47*b* which enable attachment to corresponding circular height adjusting aperture 45*a* and circular first pivot aperture 47*a* portions of the adjacent and parallel side frame portions 20, 30 using threaded fasteners 55. The arcuate second height adjusting aperture 45*b* is to provide sufficient length so as to vary a vertical position of the sander drum frame assembly 70, and the mounted sander drum assembly 150, a minimum of three inches (3 in.) vertically. Adjustment of the sander drum assembly 150 is accomplished by loosening the threaded fasteners 55 and elevating or lowering the sander drum assembly 150 by sliding the threaded fastener 55 along the arcuate second height adjusting aperture 45***b* until obtaining a desired position of the sanding strips 175 with respect to the surface of the molding 440 (also see FIG. 1). After adjustment of the sander drum frame assembly 70, the threaded fasteners 55 would be retightened.

The preferred embodiment of the present invention can be utilized by an enabled individual in a simple and straightforward manner with little or no training. After initial purchase or acquisition of the device 10, it would be arranged as indicated in FIG. 1 and attached to an existing molding machine 400 as depicted in FIGS. 2 and 3.

The method of installing and utilizing the device 10 may be achieved by performing the following steps: acquiring a model of the device 10 properly configured and having appropriate mounting brackets 60 to enable attachment of the device 10 to a particular existing molding machine 400; installing the device 10 onto machine frame portions 420 of the existing molding machine 400 using the provided mounting brackets 60 and fasteners; mounting the hinges 217 to the motor mounting plate 215, if not previously fastened; mounting the hinges 217 to existing machine frame portions 420 such that the sander shaft pulley 185 is in alignment with the motor pulley 210; installing the sander drive belt 190 onto the sander shaft pulley 185 and the motor pulley 210; allowing the gravity of the motor 200 and the pivoting nature of the hinges 217 to apply a tension upon the sander drive belt 190; mounting the out-feed roll drive belt 300 onto the out-feed roll pulley 290 and an existing out-feed roll pulley portion of the existing molding machine 400; connecting the power cord 230 portion of the motor 200 to an electrical receptacle; activating the molding machine 400 in a normal manner; activating the motor 200 of the device 10 using the power switch 225; adjusting the speed and throughput of the molding machine 400 and the device 10 as needed to achieve the optimum results; adjusting an elevation of the sander drum assembly 150 in relation to a section of molding 400 by loosening the threaded fasteners 55 between the side frames 20, 30 and sander carriage side panels 76, 78; elevating or lowering the sander drum assembly 150 by sliding the threaded fastener 55 within the second arcuate height adjusting aperture 45*b* until obtaining a desired position of the sanding strips 175 with respect to the surface of the molding 440; retightening the threaded fasteners 55; introducing appropriately sized lumber into the molding machine 400 to be shaped; allowing the properly contoured molding 440 to continue through the device 10 to be sanded by the sanding strips 175 on the rotating sander drum assembly 150; processing additional molding 440 in like manner, as needed; and, benefiting from automated improved finishing of moldings 440 in conjunction with an existing molding machine 400, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A sanding tool, comprising:

a first side frame comprising:
- a first side frame first edge;
- a first side frame second edge;
- a first side frame third edge;
- a first side frame fourth edge;
- a first side frame fifth edge;
- a first side frame sixth edge;
- a first side frame seventh edge;
- a first side frame eighth edge;
- a first side frame keyhole aperture subjacent said first side frame seventh edge and between said first side frame sixth edge and said first side frame eighth edge;
- a first side frame first height adjusting aperture subjacent said first side frame first edge and adjacent said first side frame keyhole aperture; and,
- a first side frame first pivot aperture subjacent said first side frame first edge and adjacent said first side frame first height adjusting aperture;

a second side frame comprising:
- a second side frame first edge;
- a second side frame second edge;
- a second side frame third edge;
- a second side frame fourth edge;
- a second side frame fifth edge;
- a second side frame sixth edge;
- a second side frame seventh edge;
- a second side frame eighth edge;
- a second side frame keyhole aperture subjacent said second side frame seventh edge and between said second side frame sixth edge and said second side frame eighth edge;
- a second side frame first height adjusting aperture subjacent said second side frame first edge and adjacent said second side frame keyhole aperture; and,
- a second side frame first pivot aperture subjacent said second side frame first edge and adjacent said second side frame first height adjusting aperture;

a sander drum frame assembly comprising:
- a sander drum carriage outer frame first side;
- a sander drum carriage outer frame second side positioned opposite said sander drum carriage outer frame first side;
- a sander drum carriage outer frame third side secured between a first edge of said sander drum carriage outer frame first side and said sander drum carriage outer frame second side;
- a sander drum carriage outer frame fourth side positioned opposite said sander drum carriage outer frame third side and secured between a second edge of said sander drum carriage outer frame first side and said sander drum carriage outer frame second side;
- a sander drum carriage inner frame member secured across a topside edge of said sander drum carriage outer frame third side and a topside edge of said sander drum carriage outer frame fourth side;
- a sander drum carriage outer frame first side height adjusting aperture having an arcuate shape located adjacent a first edge of said sander drum carriage outer frame first side;
- a sander drum carriage outer frame first side pivot aperture located adjacent a second edge of said sander drum carriage outer frame first side opposite said sander drum carriage outer frame first side height adjusting aperture;

a sander drum carriage outer frame second side height adjusting aperture having an arcuate shape located adjacent a first edge of said sander drum carriage outer frame second side; and, a sander drum carriage outer frame second side pivot aperture located adjacent a second edge of said sander drum carriage outer frame second side opposite said sander drum carriage outer frame second side height adjusting aperture;

wherein said sander drum frame assembly is capable of being pivotally secured between said first side frame and said second side frame when said first side frame first height adjusting aperture is aligned with said sander drum carriage outer frame first side height adjusting aperture and conjoined with a first fastener, when said first side frame first pivot aperture is aligned with said sander drum carriage outer frame first side pivot aperture and conjoined with a second fastener, when said second side frame first height adjusting aperture is aligned with said sander drum carriage outer frame second side height adjusting aperture and conjoined with a third fastener and when said second side frame first pivot aperture is aligned with said sander drum carriage outer frame second side pivot aperture and conjoined with a fourth fastener; and, wherein said sander drum frame assembly has a sander drum frame open top and a sander drum frame open bottom;

a sander drum assembly secured within said sander drum frame assembly and protruding through said sander drum frame open top and said sander drum frame open bottom;

a tension assembly secured within and between said first side frame keyhole aperture and said second side frame keyhole aperture; and, a motor capable of being in electrical communication with a power source and in mechanical communication with said sander drum assembly;

wherein said tool is securable over an output table of a molding machine comprising a cutter assembly;

wherein when said tool is actuated, a top face of a piece of molding existing within said molding machine and simultaneously supported upon said output table is brought into physical contact with said sander drum assembly; and, wherein said sander drum assembly is capable of contacting said top face of said piece of molding.

2. The sanding tool of claim 1, wherein said sander drum assembly comprises:

a first pillow block assembly secured to a top side edge of said sander drum carriage outer frame first side;

a second pillow block assembly secured to a top side edge of said sander drum carriage outer frame second side;

a sander shaft having a first plurality of journal bearings disposed adjacent a sander shaft first end and a second plurality of journal bearings disposed adjacent a sander shaft second end;

a core secured about said sander shaft between said first pillow block assembly and said second pillow block assembly;

a plurality of sanding strips radially disposed and projecting outward from an outer surface of said core;

a first lock collar secured between said first pillow block and a core first side;

a second lock collar secured between said second pillow block and a core second side;

a sander pulley secured about said sander shaft first end; and, a sander drive belt secured about said sander pulley;

wherein said first plurality of journal bearings is secured within an inner race of said first pillow block assembly;

wherein said second plurality of journal bearings is secured within an inner race of said second pillow block assembly;

wherein said sander shaft first end projects through and away from a first pillow block assembly outer face;

wherein said sander shaft second end projects through and away from a second pillow block assembly outer face; and, wherein said sander drive belt is in mechanical communication with said motor.

3. The sanding tool of claim 2, wherein said tension assembly comprises:

a sander out-feed roll comprising:

a roll cover;

a roll shaft resting within an interior space of said roll cover;

wherein a first end of said out-feed roll rests within said first side frame keyhole aperture and a second end of said out-feed roll rests within said second side frame keyhole aperture;

a first tension stud perpendicularly secured through said first side frame seventh edge, said first side frame keyhole aperture and into said sander out-feed roll first end;

a second tension stud perpendicularly secured through said second side frame seventh edge, said second side frame keyhole aperture and into said sander out-feed roll second end;

a first tension spring secured around a portion of said first tension stud which resides within said first side frame keyhole aperture;

a second tension spring secured around a portion of said second tension stud which resides with said second side frame keyhole aperture;

a first tension nut secured about a protruding portion of said first tension stud above said first side frame seventh edge;

a second tension nut secured about a protruding portion of said second tension stud above said second side frame seventh edge;

an out-feed rod pulley secured about a protruding portion of said out-feed roll second end on an exterior side of said second side frame keyhole aperture; and, an out-feed roll drive belt capable of transferring rotational motion from said molding machine to said out-feed rod pulley;

wherein a first rotation of said first tension nut and a first rotation of said second tension nut exerts a downward force upon said sander out-feed roll capable of providing continuous contact with said top face of said piece of molding; and, wherein rotation of said molding machine is capable of facilitating a rotation of said sander out-feed roll which in turn is capable of facilitating an ejection from said molding machine of said molding beneath said plurality of sanding strips when in contact with said top face of said piece of molding.

4. The sanding tool of claim 3, wherein said electrical motor comprises:

a motor mounting plate configured to secure said motor to said molding machine subjacent said output table;

a motor shaft projecting from said motor subjacent said first side frame;

a motor pulley secured about said motor shaft; and, a power cord capable of providing electrical communication between said motor and said power source;

wherein said sander drive belt is in operable communication with said motor pulley.

5. The sanding tool of claim 4, wherein said motor mounting plate is hingedly secured to said molding machine.

6. The sanding tool of claim 1, wherein said sanding tool further comprises a first mounting bracket secured to said first side frame second edge and a second mounting bracket secured to said second side frame second edge.

7. The sanding tool of claim 1, wherein said sanding tool further comprises a first side frame flange disposed upon an exterior edge of said first side frame third edge, said first side frame fourth edge, said first side frame fifth edge, said first side frame sixth edge, said first side frame seventh edge and said first side frame eighth edge; and, a second side frame flange disposed upon an exterior edge of said second side frame third edge, said second side frame fourth edge, said second side frame fifth edge, said second side frame sixth edge, said second side frame seventh edge and said second side frame eighth edge.

8. A sanding tool, comprising:

a first side frame comprising:

a first side frame first edge;

a first side frame second edge;

a first side frame third edge;

a first side frame fourth edge;

a first side frame fifth edge;

a first side frame sixth edge;

a first side frame seventh edge;

a first side frame eighth edge;

a first side frame keyhole aperture subjacent said first side frame seventh edge and between said first side frame sixth edge and said first side frame eighth edge;

a first side frame first height adjusting aperture subjacent said first side frame first edge and adjacent said first side frame keyhole aperture; and, a first side frame first pivot aperture subjacent said first side frame first edge and adjacent said first side frame first height adjusting aperture;

a second side frame comprising:

a second side frame first edge;

a second side frame second edge;

a second side frame third edge;

a second side frame fourth edge;

a second side frame fifth edge;

a second side frame sixth edge;

a second side frame seventh edge;

a second side frame eighth edge;

a second side frame keyhole aperture subjacent said second side frame seventh edge and between said second side frame sixth edge and said second side frame eighth edge;

a second side frame first height adjusting aperture subjacent said second side frame first edge and adjacent said second side frame keyhole aperture; and, a second side frame first pivot aperture subjacent said second side frame first edge and adjacent said second side frame first height adjusting aperture;

a sander drum frame assembly comprising:

a sander drum carriage outer frame first side;

a sander drum carriage outer frame second side positioned opposite said sander drum carriage outer frame first side;

a sander drum carriage outer frame third side secured between a first edge of said sander drum carriage outer frame first side and said sander drum carriage outer frame second side;

a sander drum carriage outer frame fourth side positioned opposite said sander drum carriage outer frame third side and secured between a second edge of said sander drum carriage outer frame first side and said sander drum carriage outer frame second side;

a sander drum carriage inner frame member secured across a topside edge of said sander drum carriage outer frame third side and a topside edge of said sander drum carriage outer frame fourth side;

a sander drum carriage outer frame first side height adjusting aperture having an arcuate shape located adjacent a first edge of said sander drum carriage outer frame first side;

a sander drum carriage outer frame first side pivot aperture located adjacent a second edge of said sander drum carriage outer frame first side opposite said sander drum carriage outer frame first side height adjusting aperture;

a sander drum carriage outer frame second side height adjusting aperture having an arcuate shape located adjacent a first edge of said sander drum carriage outer frame second side; and, a sander drum carriage outer frame second side pivot aperture located adjacent a second edge of said sander drum carriage outer frame second side opposite said sander drum carriage outer frame second side height adjusting aperture;

wherein said sander drum frame assembly is capable of being pivotally secured between said first side frame and said second side frame when said first side frame first height adjusting aperture is aligned with said sander drum carriage outer frame first side height adjusting aperture and conjoined with a first fastener, when said first side frame first pivot aperture is aligned with said sander drum carriage outer frame first side pivot aperture and conjoined with a second fastener, when said second side frame first height adjusting aperture is aligned with said sander drum carriage outer frame second side height adjusting aperture and conjoined with a third fastener and when said second side frame first pivot aperture is aligned with said sander drum carriage outer frame second side pivot aperture and conjoined with a fourth fastener; and, wherein said sander drum frame assembly has a sander drum frame open top and a sander drum frame open bottom;

a sander drum assembly secured within said sander drum frame assembly and protruding through said sander drum frame open top and said sander drum frame open bottom;

a tension assembly secured within and between said first side frame keyhole aperture and said second side frame keyhole aperture;

a motor capable of being in electrical communication with a power source and in mechanical communication with said sander drum assembly; and, a molding machine comprising:

an output table; and, a cutter assembly;

wherein said tool is secured over said output table of said molding machine;

wherein when said tool is actuated, a top face of a piece of molding existing within said molding machine and simultaneously supported upon said output table is brought into physical contact with said sander drum assembly; and, wherein said sander drum assembly abrasively is capable of contacting said top face of said piece of molding.

9. The sanding tool of claim 8, wherein said sander drum assembly comprises:

a first pillow block assembly secured to a top side edge of said sander drum carriage outer frame first side;

a second pillow block assembly secured to a top side edge of said sander drum carriage outer frame second side;

a sander shaft having a first plurality of journal bearings disposed adjacent a sander shaft first end and a second plurality of journal bearings disposed adjacent a sander shaft second end;

a core secured about said sander shaft between said first pillow block assembly and said second pillow block assembly;

a plurality of sanding strips radially disposed and projecting outward from an outer surface of said core;

a first lock collar secured between said first pillow block and a core first side;

a second lock collar secured between said second pillow block and a core second side;

a sander pulley secured about said sander shaft first end; and, a sander drive belt secured about said sander pulley;

wherein said first plurality of journal bearings is secured within an inner race of said first pillow block assembly;

wherein said second plurality of journal bearings is secured within an inner race of said second pillow block assembly;

wherein said sander shaft first end projects through and away from a first pillow block assembly outer face;

wherein said sander shaft second end projects through and away from a second pillow block assembly outer face; and, wherein said sander drive belt is in mechanical communication with said motor.

10. The sanding tool of claim 9, wherein said tension assembly comprises:

a sander out-feed roll comprising:

a roll cover;

a roll shaft resting within an interior space of said roll cover;

wherein a first end of said out-feed roll rests within said first side frame keyhole aperture and a second end of said out-feed roll rests within said second side frame keyhole aperture;

a first tension stud perpendicularly secured through said first side frame seventh edge, said first side frame keyhole aperture and into said sander out-feed roll first end;

a second tension stud perpendicularly secured through said second side frame seventh edge, said second side frame keyhole aperture and into said sander out-feed roll second end;

a first tension spring secured around a portion of said first tension stud which resides within said first side frame keyhole aperture;

a second tension spring secured around a portion of said second tension stud which resides with said second side frame keyhole aperture;

a first tension nut secured about a protruding portion of said first tension stud above said first side frame seventh edge;

a second tension nut secured about a protruding portion of said second tension stud above said second side frame seventh edge;

an out-feed rod pulley secured about a protruding portion of said out-feed roll second end on an exterior side of said second side frame keyhole aperture; and, an out-feed roll drive belt capable of transferring rotational motion from said molding machine to said out-feed rod pulley;

wherein a first rotation of said first tension nut and a first rotation of said second tension nut exerts a downward force upon said sander out-feed roll capable of providing continuous contact with said top face of said piece of molding; and, wherein rotation of said molding machine is capable of facilitating a rotation of said sander out-feed roll which in turn is capable of facilitating an ejection from said molding machine of said molding beneath said plurality of sanding strips when in contact with said top face of said piece of molding.

11. The sanding tool of claim 10, wherein said electrical motor comprises:

a motor mounting plate configured to secure said motor to said molding machine subjacent said output table;

a motor shaft projecting from said motor subjacent said first side frame;

a motor pulley secured about said motor shaft; and, a power cord capable of providing electrical communication between said motor and said power source;

wherein said sander drive belt is in operable communication with said motor pulley.

12. The sanding tool of claim 11, wherein said motor mounting plate is hingedly secured to said molding machine.

13. The sanding tool of claim 8, wherein said sanding tool further comprises a first mounting bracket secured to said first side frame second edge and a second mounting bracket secured to said second side frame second edge.

14. The sanding tool of claim 8, wherein said sanding tool further comprises a first side frame flange disposed upon an exterior edge of said first side frame third edge, said first side frame fourth edge, said first side frame fifth edge, said first side frame sixth edge, said first side frame seventh edge and said first side frame eighth edge; and, a second side frame flange disposed upon an exterior edge of said second side frame third edge, said second side frame fourth edge, said second side frame fifth edge, said second side frame sixth edge, said second side frame seventh edge and said second side frame eighth edge.

* * * * *